US005640910A

United States Patent [19]

Pouyt et al.

[11] Patent Number: 5,640,910

[45] Date of Patent: Jun. 24, 1997

[54] METHOD FOR ADJUSTING THE ORIENTATION OF TRAVELLING WHEEL ASSEMBLIES

[75] Inventors: Daniel Pouyt, Ollon; Laurent Donato, Clarens, both of Switzerland

[73] Assignee: Vevey Technologies S.A., Villeneuve, Switzerland

[21] Appl. No.: 496,197

[22] Filed: Jun. 28, 1995

[30] Foreign Application Priority Data

Jul. 13, 1994 [CH] Switzerland ..... 2230/94

[51] Int. Cl.[6] ..... B61F 5/00

[52] U.S. Cl. ..... 105/168

[58] Field of Search ..... 105/168, 165, 105/167

[56] References Cited

U.S. PATENT DOCUMENTS

| | | | |
|---|---|---|---|
| 4,289,075 | 9/1981 | Smith | 105/168 |
| 4,982,671 | 1/1991 | Chollet et al. | 105/168 |
| 5,429,056 | 7/1995 | Pees et al. | 105/168 |

FOREIGN PATENT DOCUMENTS

| | | | |
|---|---|---|---|
| 0 007 225 | 1/1980 | European Pat. Off. . | |
| 0 318 923 | 6/1989 | European Pat. Off. . | |
| 0 329 440 | 8/1989 | European Pat. Off. . | |
| 0 575 696 | 12/1993 | European Pat. Off. . | |
| 2622164 | 4/1989 | France | 105/168 |
| 42 24 467 | 1/1994 | Germany . | |
| 2-34465 | 2/1990 | Japan | 105/168 |
| 4-303062 | 10/1992 | Japan | 105/168 |

*Primary Examiner*—Mark T. Le

*Attorney, Agent, or Firm*—Young & Thompson

[57] ABSTRACT

The string of vehicles travelling on rails includes bodies (2, 3, 4) articulated together and wheel assemblies (8 to 11), wherein the orientation of the wheels can be adjusted to be tangent to the rails. To this end, an adjusting device includes sensors (40), which make is possible to measure the relative angles ($\beta 1$, $\beta 2$) between the longitudinal axes (31) of the bodies. A calculating unit (41) is designed for determining for each unitary vehicle (8 to 11) the variable angle ($\alpha 1$, $\alpha 2$, $\alpha 3$, $\alpha 4$) between a direction perpendicular to the axes (37) of the wheels and the longitudinal axis (31) of the body concerned, from the values of the relative angles ($\beta 1$, $\beta 2$) measured and, preferably, in combination with the angular speed of rotation of the bodies around their vertical axis, measured with gyroscopic sensors provided on the bodies. An adjusting member in the form of a jack then adjusts the orientation of the wheels according to the variable angles calculated. Such an adjustment of the wheels makes it possible to orient precisely the wheels, under conditions of increased safety, while reducing the cost of vehicles travelling on railways, in particular of those having a very low floor.

11 Claims, 6 Drawing Sheets

METHOD FOR ADJUSTING THE ORIENTATION OF TRAVELLING WHEEL ASSEMBLIES

FIELD OF THE INVENTION

The present invention is concerned with a method for adjusting the orientation of wheel assemblies having wheels which can be oriented, in a string of vehicles travelling on rails and including at least two unitary vehicles, such as wagons or wagon bodies which are articulated and/or coupled together, the string of vehicles being supported on the rails through wheel assemblies having wheels which can be oriented and of which the principal planes form variable angles with a direction parallel to the longitudinal axis of the unitary vehicle under which they are mounted, the method being carried out by adjusting said variable angles according to the curvature of the rails, in such a manner that the principal planes of the wheels coincide substantially with lines tangent to the rails.

BACKGROUND OF THE INVENTION

In such strings of vehicles, in particular in tramways, it is in certain cases very important to lower as much as possible the floor of the vehicle. It is then not possible to use any more bogies with two or more axles. Preferably, wheel assemblies will then be used which carry only two wheels which will need to be guided in a suitable manner.

Such a string of articulated vehicles travelling on rails is known, in which the wheel assemblies are guided mechanically, by means of a guiding pulley cooperating with a side rail. This device requires the provision of an additional guiding rail and cannot therefore be implemented in all urban environments. Furthermore, the system is very expensive.

SUMMARY OF THE INVENTION

The purpose of the present invention is to remedy to these draw-backs and the invention is characterized in that the relative angle between the longitudinal axes of at least two unitary vehicles is measured, in that said variable angles are calculated for at least one of the wheel assemblies on the basis of said relative angle measured, and in that the wheels are oriented in accordance with said calculated variable angles.

Accordingly, a string of articulated vehicles travelling on rails is provided, in which the wheels are at all times tangential to the rails. The safety against derailment is hence increased. The typical grating sound produced in curved sections by tramways is, if not eliminated, at least substantially decreased and the wear of the wheels is considerably reduced. Furthermore, the method is implemented by simple means and at a relatively low cost. Owing to the fact that the orientation of the wheels is achieved through calculation and not through mechanical control, the adjustment of the wheels can be adapted to any section of a railway line and can be modified and improved subsequently, at a very low cost.

An advantageous version is characterized in that the position of the wheel assemblies is identified in a system of coordinates, in that a function of the arc of at least one osculatory circle passing through the centers of three wheel assemblies is determined and in that the value of said variable angles is determined from the derivative of said function of the arc of the circle.

Since railway lines consist of straight sections and of sections having the shape of arcs of circles, such an arrangement makes it possible to obtain very easily a proper orientation of the wheels.

Advantageously, one can correct the variable angles obtained from the osculatory circle(s) by means of empiric corrective functions, based on the variation of said relative angles for a certain distance travelled.

Thus, irregularities of a railway line can be taken into account, such as when entering or exiting from a simple curve or those of S-curves.

The method can be adapted to strings of vehicles including at least three unitary vehicles and at least four wheel assemblies. It is then characterized in that a first relative angle is measured between a first and a second unitary vehicle and also a second relative angle between the second and a third unitary vehicle, in that at least these two relative angles are used for determining at least two functions of the arcs of at least two osculatory circles, a first one passing through the centers of the first three wheel assemblies, the second passing through the centers of the last three wheel assemblies, and in that the value of said variable angles is determined from the derivatives of the two functions of the arc of the circle, the value of the variable angles of the wheel assemblies belonging to two osculatory circles being obtained by averaging the values obtained on each one of the osculatory circles.

The method can also be adapted to strings of vehicles having a number of unitary vehicles in excess of three, and is then characterized in that a plurality of osculatory circles are then determined per group of three wheel assemblies, all the wheel assemblies except those at the end of the string of vehicles being used for the interpolation of two osculatory circles and the relative angles being obtained by averaging the values obtained for each one of the two osculatory circles, the variable angles obtained being corrected by means of said corrective functions.

With these methods, one obtains a very accurate orientation of the wheels, while using means which are inexpensive and which can be adapted at any time.

The invention is also concerned with a string of vehicles travelling on rails in which the orientation of the wheels is adjusted according to the above described method, and which includes at least two unitary vehicles, such as wagons or wagon bodies articulated and/or coupled together, the string of vehicles being supported on rails by wheel assemblies with wheels which can be oriented and of which the principal plane forms a variable angle with a direction parallel to the longitudinal axis of the unitary vehicle under which they are mounted, the string of vehicles being characterized in that it includes at least one adjusting device designed for adjusting said variable angle according to the curvature of the rails, in such a manner that the principal plane of the wheels coincides substantially with a line tangent to the rails, this adjusting device including at least one measuring member capable of determining the relative angle between the longitudinal axes of at least two unitary vehicles, at least one calculating unit designed for calculating the variable angles for each one of the wheel assemblies from said relative angle, and adjusting members associated with the wheel assemblies which can orient the wheels according to said variable angle calculated.

The string of vehicles travelling on rails according to the invention is provided with means, which make it possible to achieve a precise orientation of the wheels and hence improve safety, while being easy to assemble and inexpensive.

BRIEF DESCRIPTION OF THE DRAWINGS

Other advantages will become apparent from the characteristic features set forth in the dependent claims and in the following detailed description of the invention, made with reference to the drawings showing schematically two exemplary embodiments of the invention and alternate versions thereof.

DESCRIPTION OF THE PREFERRED EMBODIMENT

Figure 1:
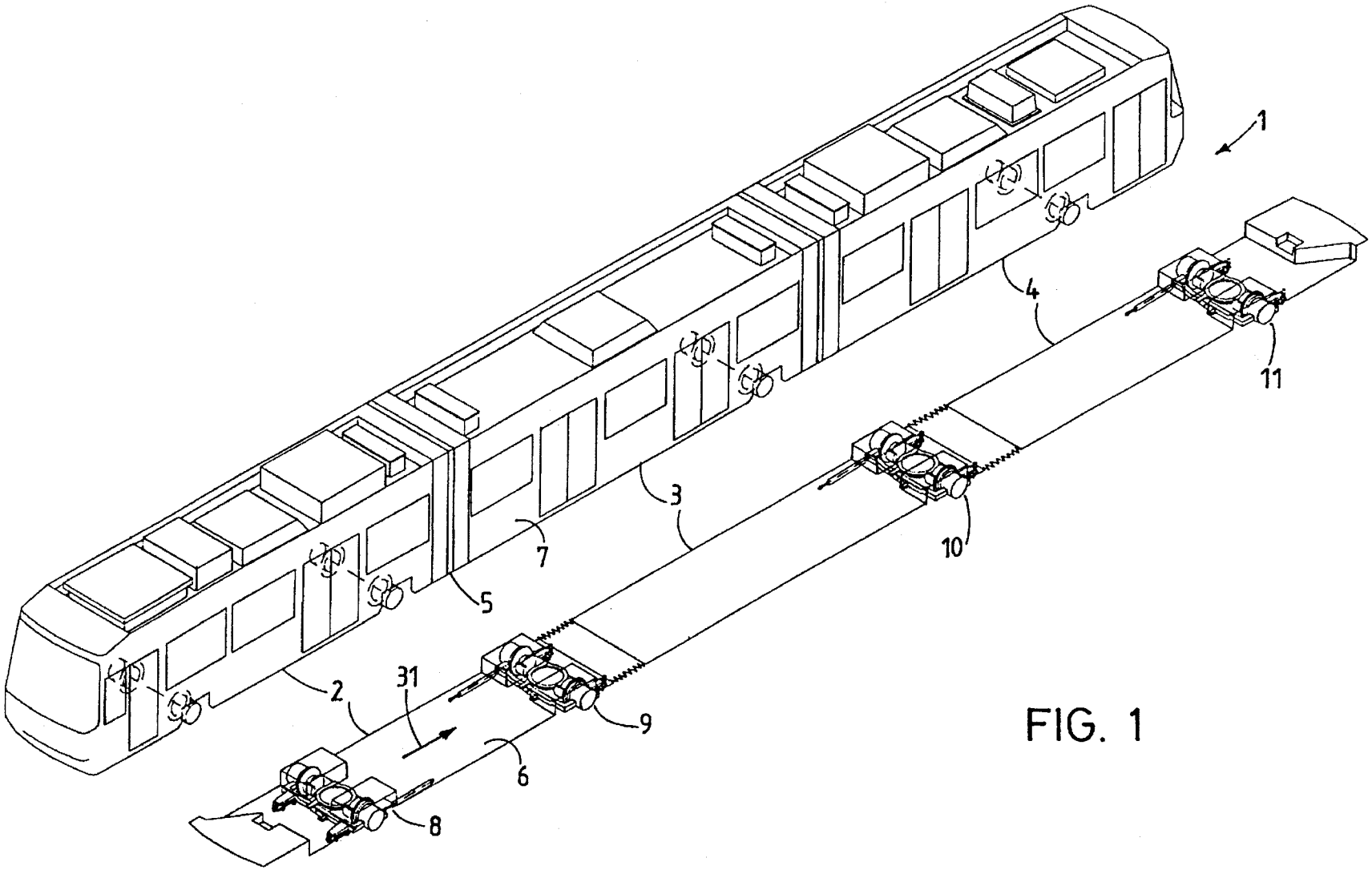
FIG. 1 is a schematic perspective view of a first exemplary embodiment, in the form of a tramway, the upper part of the vehicle being shown removed from the underframe, for sake of clarity.
Figure 2:
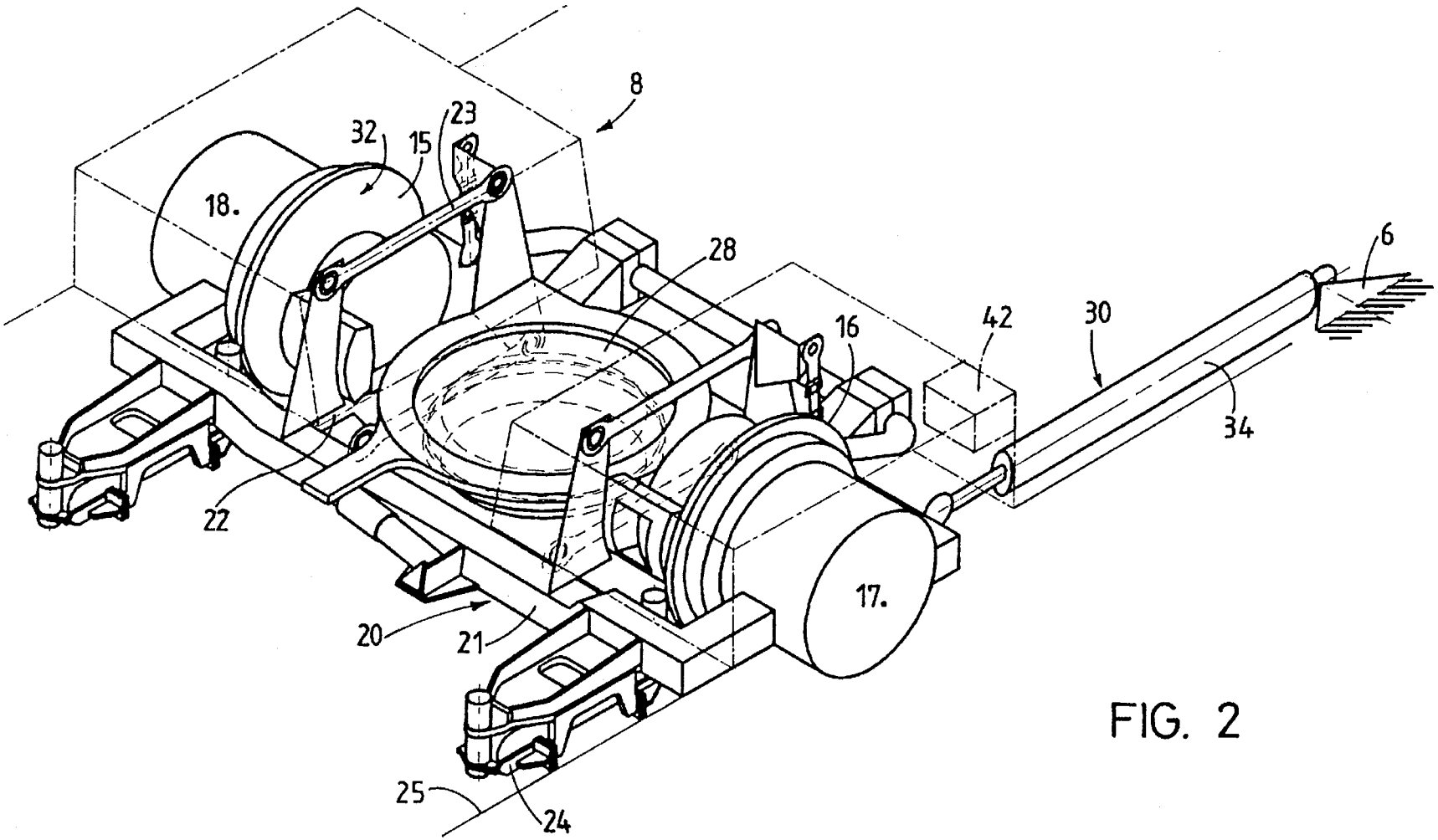
FIG. 2 is a schematic perspective view of a wheel assembly used in the vehicle illustrated in FIG. 1.

The string of vehicles travelling on rails shown in FIG. 1 is a tramway 1 comprised of three unitary vehicles or bodies 2, 3 and 4, articulated together movably by means of bellow articulations 5. Each body consists of an underframe 6 and of a superstructure 7. The first body 2 has two wheel assemblies 8, 9, each having two wheels which can be oriented, while the second and third bodies 3, 4 carry each only one wheel assembly 10, 11. This assembly, which is a two-wheel bogie, is illustrated in more detail in FIG. 2. It has two wheels 15, 16 driven by separate motors 17, 18, of which the body is fastened to a frame 20 of the wheel assembly. The frame 20 has two crossbeams 21 connected by struts 22 and stabilizer beams 23. The frame further supports electromagnetic brakes 24 designed for cooperation with the rails 25. A crown 28 rigidly connected to the frame 20 via the beams 23 acts as a pivot for connexion with the body 2, 3 or 4 under which the wheel assembly is mounted rotatably.

Furthermore, the string of vehicles travelling on rails includes, associated with each wheel assembly 8 to 11, an adjusting device 30 designed for adjusting a variable angle ($\alpha j$) between the principal plane 32 of the wheels 15, 16 and a direction parallel to the longitudinal axis 31 of the bodies 2, 3, or 4 under which the wheel assembly is mounted. This adjusting device makes it possible to adjust the orientation of the wheels according to the curvature of the rails, so that the plane of the wheels 32 coincides substantially with the line tangent to the rails. To this end, the adjusting device includes an adjusting member in the form of a controlled jack 34 connecting the frame 20 of the wheel assembly to the underframe 6 of the bodies 2, 3 or 4.

Figure 3:
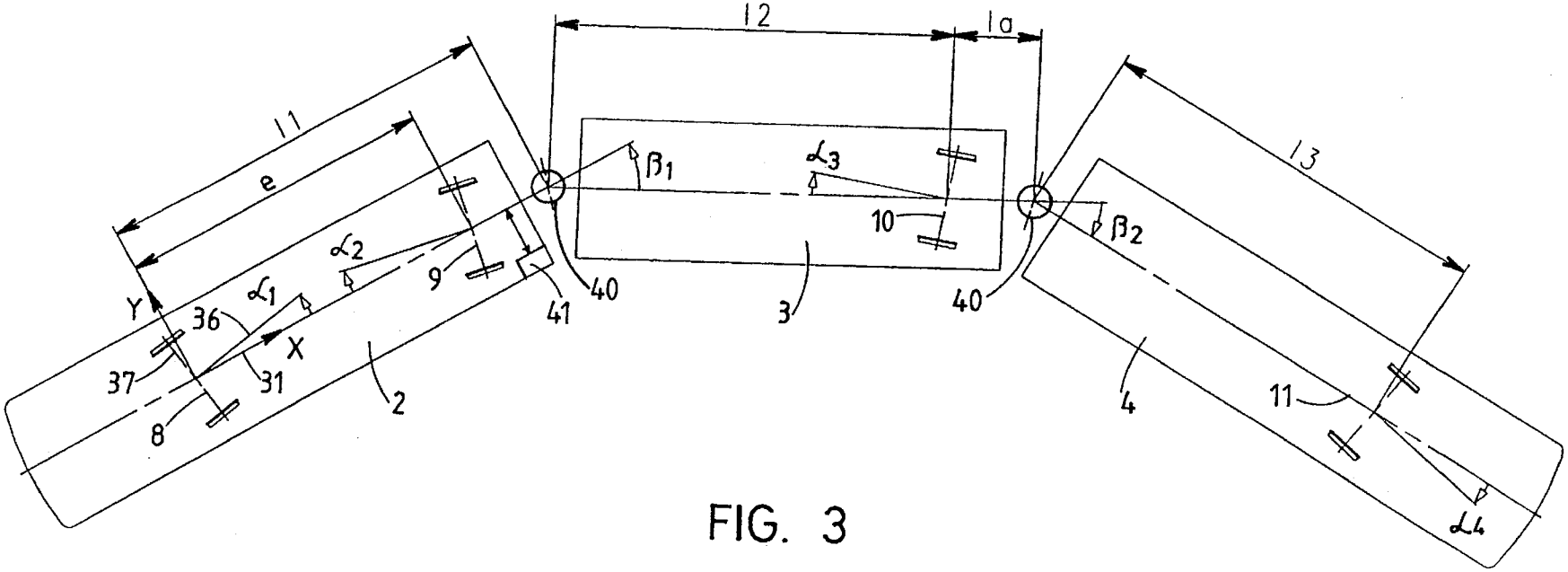
FIG. 3 is a schematic plan view of the vehicle of FIG. 1.

FIG. 3 illustrates schematically the bodies 2, 3 rind 4, the wheel assemblies 8 to 11 being oriented in such a manner that the planes of the wheels or the lines 36 perpendicular to the axes 37 of the wheels form variable angles $\alpha 1$, $\alpha 2$, $\alpha 3$ or $\alpha 4$ with the longitudinal axes 31 of each one of the bodies 2, 3, 4. The relative angles $\beta 1$ and $\beta 2$, formed between the longitudinal axes 31 of the first body 2 and of the second body 3, and between the longitudinal axes 31 of the second body 3 and the third body 4, respectively, are used for calculating the variable angles $\alpha 1$, $\alpha 2$, $\alpha 3$ and $\alpha 4$. To this end, the tramway includes measuring members 40, one associated with each articulation between two bodies, in the form of sensors designed for measuring the relative angle $\beta 1$ or $\beta 2$. These sensors 40 ace placed under the articulation crown. A part of the sensor is fastened to the crown, while another part thereof is fastened to the body. An inductive or capacitive measuring system makes it possible to determine, from the variation of the field recorded between the two components of the sensor, the rotation of the crown. The measured values of the variable angles $\beta 1$, $\beta 2$ are fed to a calculating unit 41, which calculates the value of each one of the angles $\alpha j$ of each one of the wheel assemblies. The values of the angle $\alpha j$ are fed to servocontrol units 42 (FIG. 2) designed for controlling the movement of the jacks 34 associated with each one of the wheel assemblies, for orienting the wheels according to said variable angles $\alpha j$, calculated in such a manner that the principal planes of the wheels coincide substantially with the lines tangent to the rails.

The calculating unit 41 is arranged is such a manner as to calculate the equation of the trajectory of the rails, from which the tangent to the trajectory can be calculated at any point, which enables the perfect positioning of the wheels of the wheel assemblies, thus minimizing their friction on the rails.

The choice of the functions for establishing the equation of the trajectory of rails is relatively simple, since the trajectories generally consist of straight lines or of arcs of circles. The functions used will therefore be straight lines and osculatory circles, of which the parameters need to be calculated, namely the coordinates a and b of their centers and their radii $\rho$.

Let us consider the case of a string comprised of three bodies (FIG. 3). A system of coordinates is attached to the first body. The centers of the first three wheel assemblies or bogies are located in this system; they define the first osculatory circle. The centers of the three last wheel assemblies or bogies are located similarly and they define the second osculatory circle.

The derivatives of the osculatory circles at positions corresponding to the centers of the wheel assemblies give the direction of tangential lines of the wheels. When a wheel assembly belongs to two osculatory circles, there are two tangential lines. The final result is obtained by averaging the two tangential lines.

When the tramway travels along a straight section or along a curved section of a constant radius, the mathematical approximation will be exact. In all other cases (entry into a curved portion, curved portion with a variable radius, etc), an error will appear. This error can be decreased if required through the use of corrective functions, based on the variation of the angles $\Delta\beta$ between the bodies for a given travelled distance.

The following symbols will be used hereafter:

| | |
|---|---|
| a, b [m] | coordinates of the centers of the osculatory circles |
| e [m] | distance between the pivots of the wheel assemblies |
| 1, 1a [m] | distance between the wheel assemblies and the articulations |
| m | slope of the lines tangent to the osculatory circles |
| s [m] | distance travelled |
| t [sec] | time |
| v [m/sec] | speed |
| x, y [m] | coordinates of the centers of the wheel assemblies |
| G, H, K, L [m] | correction factors which depend upon the geometry of the unitary vehicle and on the wheel assembly concerned |
| $\alpha$ [degrees] | variable angle with respect to the axis of the |

-continued

| | |
|---|---|
| | body |
| αC. [degrees] | variable angle with respect to the axis of the body, after correction |
| β [degrees] | relative angle between the bodies |
| γ [degrees/m] | constant, corresponding to a limit of a measuring interval |
| ρ [m] | radius of the osculatory circles |
| Ψ [degrees] | angle of the lines tangent to the first osculatory circle |
| Ψ' [degrees] | angle of the lines tangent to the second osculatory circle |
| χ | matrix |

The coordinates of the centers of the wheel assemblies are given by the following equations:

$$\begin{bmatrix} x1 \\ x1 \end{bmatrix} = \begin{bmatrix} 0 \\ 0 \end{bmatrix} \tag{1.1}$$

$$\begin{bmatrix} x2 \\ y2 \end{bmatrix} = \begin{bmatrix} e \\ 0 \end{bmatrix} \tag{1.2}$$

$$\begin{bmatrix} x3 \\ y3 \end{bmatrix} = \begin{bmatrix} l1 \\ 0 \end{bmatrix} + l2 \begin{bmatrix} \cos(\beta 1) \\ \sin(\beta 1) \end{bmatrix} \tag{1.3}$$

$$\begin{bmatrix} x4 \\ y4 \end{bmatrix} = \begin{bmatrix} l1 \\ 0 \end{bmatrix} + (l2 + la) \begin{bmatrix} \cos(\beta 1) \\ \sin(\beta 1) \end{bmatrix} + l3 \begin{bmatrix} \cos(\beta 2) \\ \sin(\beta 2) \end{bmatrix} \tag{1.4}$$

A circle with a radius ρ and a center (a, b) is found which passes through a group of three points corresponding to the centers of the wheel assemblies. The equation of the circle is of the type:

$$(x-a)^2+(y-b)^2=\rho^2 \tag{1.5}$$

which can be written as a function of an arc of a circle:

$$y=\sqrt{\rho^2-(x-a)^2}+b \tag{1.6}$$

The derivative m=y'(x) of 1.6 is given by the equation:

$$m=\frac{a-x}{\sqrt{\rho^2-(x-a)^2}} \tag{1.7}$$

The value of this derivative at point x gives the slope of the line tangent to the arc of the circle at the point considered. Its angle with the x-axis is $$\Psi=\mathrm{arctg}(m) \tag{1.8}$$

The calculation of the coordinates of the center and of the radius ρ of the osculatory circles amounts to resolving a system of three equations (1.5) with three unknown values (a, b and ρ) and which can be written, in the ease of the first osculatory circle, in the following matrix form:

$$\begin{bmatrix} a1 \\ b1 \end{bmatrix} = \chi_1^{-1} \begin{bmatrix} x1^2 - x2^2 + y1^2 - y2^2 \\ x1^2 - x3^2 + y1^2 - y3^2 \end{bmatrix} \tag{1.9}$$

where $$\chi_1 = 2 \begin{bmatrix} x1 - x2 & y1 - y2 \\ x1 - x3 & y1 - y3 \end{bmatrix} \tag{1.10}$$

and for the second circle:

$$\begin{bmatrix} a2 \\ a2 \end{bmatrix} = \chi_2^{-1} \begin{bmatrix} x2^2 - x3^2 + y2^2 - y3^2 \\ x2^2 - x4^2 + y2^2 - y4^2 \end{bmatrix} \tag{1.11}$$

where $$\chi_2 = 2 \begin{bmatrix} x2 - x3 & y2 - y3 \\ x2 - x4 & y2 - y4 \end{bmatrix} \tag{1.12}$$

The radii ρ1 and ρ2 of the osculatory circles are calculated using the equation 1.5.

The determination of the centers (a1, b1), (a2, b2) and of the radii ρ1 and ρ2 of the two circles makes it possible to calculate all the angles Ψ, using the equations (1.7) and (1.8).

In order to determine the variable angles α between the wheel assemblies and the axes of the bodies, one must further calculate the relative angle β of the corresponding body. Furthermore, for all the wheel assemblies 9 and 10 belonging to the two circles, the final result is obtained by averaging the two angles Ψ and Ψ' calculated respectively for the first and the second circles. Thus:

$$\alpha 1=\Psi 1 \tag{1.13}$$

$$\alpha 2=\tfrac{1}{2}(\Psi 2+\Psi 2') \tag{1.14}$$

$$\alpha 3=\tfrac{1}{2}(\Psi 3+\Psi 3')-\beta 1 \tag{1.15}$$

$$\alpha 4=\Psi 4'-(\beta 1+\beta 2) \tag{1.16}$$

The angles given by the equations (1.13) to (1.16) can be corrected by empirical functions when the actual trajectory of the rails differs too much from a straight line or from a curve with a constant radius, for example when entering a simple curve, in an S-curve, etc.

The corrective functions are based on the variation of the relative angles β1 and β2 between the bodies for a travelled distance of Δ s. Thus, the corrected variable angles αjc fed to the adjusting devices of the wheel assemblies are as follows:

For β2=0 and for Δβ2=0 and for:

$$\begin{bmatrix} \Delta\beta 1 \\ \Delta s \end{bmatrix} \in [\gamma i, \gamma i+1] \Rightarrow \alpha 1c = \alpha 1 + \frac{\Delta\beta 1}{\Delta s} Ki \tag{1.17}$$

$$\Rightarrow \alpha 2c = \alpha 2 + \frac{\Delta\beta 1}{\Delta s} Li \tag{1.18}$$

$$\forall \left| \begin{matrix} \Delta\beta 1 \\ \Delta s \end{matrix} \right| \Rightarrow \alpha 3c = \alpha 4c = 0 \tag{1.19}$$

For $\Delta\beta 2 \neq 0$ $$\alpha jc = \alpha j + \frac{\Delta\beta 1}{\Delta s} Gj + \frac{\Delta\beta 2}{\Delta s} Hj \tag{1.20}$$

$j = 1 \ldots 4$ depending on the wheel assembly concerned where $$\Delta\beta=\beta(t+\Delta t)-\beta(t) \tag{1.21}$$

$$\Delta S=V\Delta t \tag{1.22}$$

The intervals defined by the different values γ can be narrowed as desired.

The correction factors Kj, Lj, Gj, Hj depend upon the geometry of the tramway. They are obtained empirically by comparing the theoretical results obtained with the equations (1.13) to (1.16) with virtual values obtained by computer simulation for example.

Figure 4:
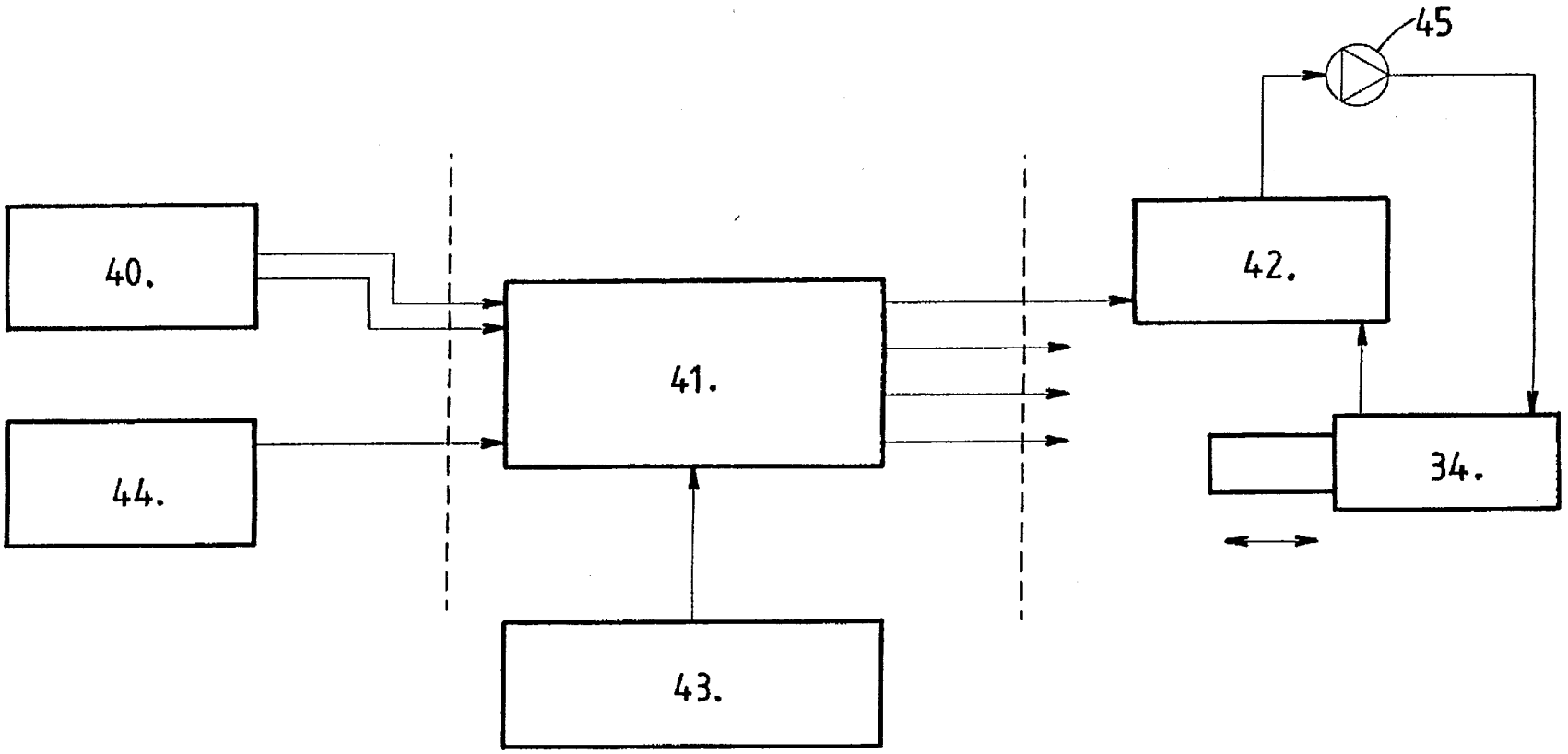
FIG. 4 is a block diagram of the adjusting device used in the vehicle illustrated in FIG. 1.

In the schema represented in FIG. 4, the calculating unit 41 is connected to the power supply 43 and receives the value of the relative angles β1 and β2 from the sensors 40 and the signal from the tachometer 44 of the string of vehicles running on rails. It feeds the calculated values of the variable angles αjc to the servocontrols 42. The latter control the hydraulic jacks 34 via a pump 45 in such a manner as to adjust the orientation of the wheels in accordance with the variable angle αjc calculated.

Figure 5:
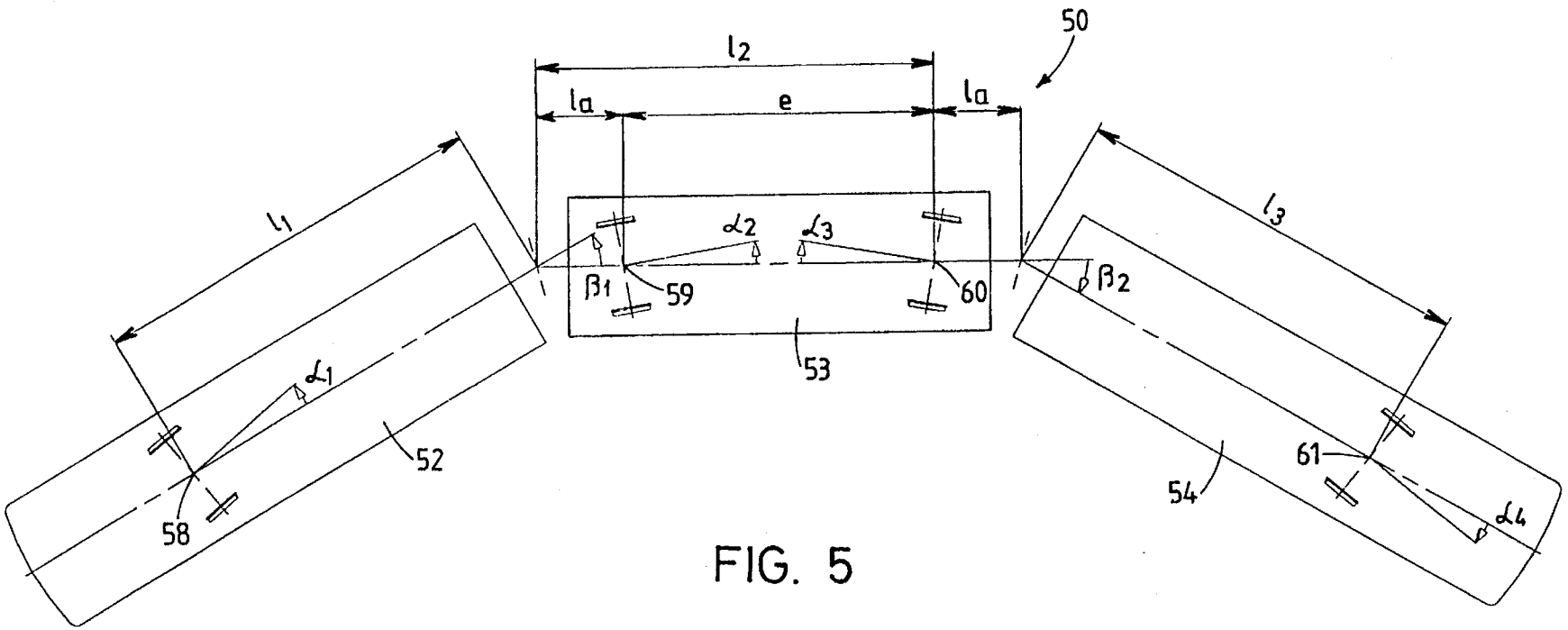
FIG. 5 is a schematic plan view of an alternate version showing a different arrangement of the wheel assemblies.

FIG. 5 shows another version of the string of vehicles 50 travelling on rails, also comprised of three bodies 52, 53, 54. The first body 52 has a wheel assembly 58, the second body 53 has two wheel assemblies 59, 60 and the third body 54 a single wheel assembly 61. The string of vehicles 50 travelling on rails is symmetrical with respect to its center and the lengths 11 and 13 amount to 7.50 m, the distance e between the pivots of the wheel assemblies to 6.50 m, the length 1*a* to 1.75 m and the length 12 to 8.25 m.

The coordinates of the centers of the wheel assemblies are given by the following vectors:

$$\begin{bmatrix} x1 \\ y1 \end{bmatrix} = \begin{bmatrix} 0 \\ 0 \end{bmatrix} \tag{2.1}$$

$$\begin{bmatrix} x2 \\ y2 \end{bmatrix} = \begin{bmatrix} e \\ 0 \end{bmatrix} \tag{2.2}$$

$$\begin{bmatrix} x3 \\ y3 \end{bmatrix} = \begin{bmatrix} l1 \\ 0 \end{bmatrix} + l2 \begin{bmatrix} \cos(\beta 1) \\ \sin(\beta 1) \end{bmatrix} \tag{2.3}$$

$$\begin{bmatrix} x4 \\ y4 \end{bmatrix} = \begin{bmatrix} l1 \\ 0 \end{bmatrix} + (l2 + la) \begin{bmatrix} \cos(\beta 1) \\ \sin(\beta 1) \end{bmatrix} + l3 \begin{vmatrix} \cos(\beta 2) \\ \sin(\beta 2) \end{vmatrix} \tag{2.4}$$

As previously, the center and the radius of the two osculatory circles are calculated in accordance with the equations 1.5 to 1.12, to obtain the variable angles:

$$\alpha 1 = \Psi 1 \tag{2.5}$$

$$\alpha 2 = \tfrac{1}{2}(\Psi 2 + \Psi 2') - \beta 1 \tag{2.6}$$

$$\alpha 3 = \tfrac{1}{2}(\Psi 3 + \Psi 3') - \beta 1 \tag{2.7}$$

$$\alpha 4 = \Psi 4' - (\beta 1 + \beta 2) \tag{2.8}$$

The corrected variable angles αjc fed to the adjusting device 42 of the wheel assemblies are of the form:

For β2=0 and Δβ2=0 and for $$\left[\frac{\Delta\beta 1}{\Delta s}\right] \in [0{:}5] \Rightarrow \alpha 1c = \alpha 1 + \frac{\Delta\beta 1}{\Delta s}\, 3.45 \tag{2.9}$$

$$\left[\frac{\Delta\beta 1}{\Delta s}\right] \in [5{:}10] \Rightarrow \alpha 1c = \alpha 1 + \frac{\Delta\beta 1}{\Delta s}\, 2.29 \tag{2.10}$$

$$\left[\frac{\Delta\beta 1}{\Delta s}\right] \in [10{:}15] \Rightarrow \alpha 1c = \alpha 1 + \frac{\Delta\beta 1}{\Delta s}\, 1.49 \tag{2.11}$$

$$\left[\frac{\Delta\beta 1}{\Delta s}\right] \in [15{:}20] \Rightarrow \alpha 1c = \alpha 1 + \frac{\Delta\beta 1}{\Delta s}\, 0.71 \tag{2.12}$$

$$\forall \left[\frac{\Delta\beta 1}{\Delta s}\right] \Rightarrow \alpha 2c = \alpha 3c = \alpha 4c = 0 \tag{2.13}$$

In the embodiment with two central bogies, no correction of α2 defined by equation (1.18) is carried out. This simple example illustrates the flexibility of the method, which is directly applicable to any particular geometry.

For Δβ2≠0:

$$\alpha 1c = \alpha 1 + \frac{\Delta\beta 1}{\Delta s}\, 0.3 \tag{2.14}$$

$$\alpha 2c = \alpha 2 + \frac{\Delta\beta 1}{\Delta s}\, 0.16 + \frac{\Delta\beta 2}{\Delta s}\, 0.34 \tag{2.15}$$

$$\alpha 3c = \alpha 3 + \frac{\Delta\beta 1}{\Delta s}\, 0.25 - \frac{\Delta\beta 2}{\Delta s}\, 0.35 \tag{2.16}$$

$$\alpha 4c = \alpha 4 + \frac{\Delta\beta 2}{\Delta s}\, 0.05 \tag{2.17}$$

Clearly, the above described embodiments do not limit in any manner the scope of the invention and they can receive any desirable modification. In particular, the adjusting and the mathematical calculations described above can be applied to any strings of vehicles travelling on rails, including tramways, trains, underground trains with differing numbers of unitary vehicles or wagons, and with differing numbers of wheel assemblies, or bogies. In the case of a string including two unitary bodies only, the adjusting is based on a single osculatory circle and the equations 1.14 and 1.15 are simplified. Only the variation of the relative angle β1 will be used for the correction, which will have the form of equation 1.17 for the three angles αjc.

Should the string be comprised of four bodies or more, the same approach is adopted, i. e. a plurality of osculatory circles are drawn, one per group of three wheel assemblies. With the exception of the two end wheel assemblies, all the wheel assemblies are used for the interpolation of two osculatory circles and the angle of the tangent line is obtained by averaging according to (1.15). The corrective functions (1.17) to (1.19) remain valid. Equation (1.20) is applicable to the angles αjc pertaining to a given body, by introducing the two relative angles β corresponding to the articulations of this body.

Needless to say, the invention is also applicable to strings of vehicles travelling on rails (tramways, trains, ere) including any number of wheel assemblies, whether the latter are located under the unitary vehicles or between the unitary vehicles. These unitary vehicles can also include, alongside at least one wheel assembly with a controlled orientation, a certain number of conventional bogies having at least two axles and which assume the proper orientation automatically.

The variable angles αj for each one of the wheel assemblies can also be calculated using geometrical functions which are more complex than osculatory circles.

When the string of vehicles travelling on rails is used on some specific route, it is also possible to memorize the relative angles βm measured and to calculate and memorize the variable angles αjc calculated in a very precise manner with more refined corrective functions including for example correction factors Gj, Hj, Kj, Lj which are modified according to the route of travel, which is memorized.

Figure 6:
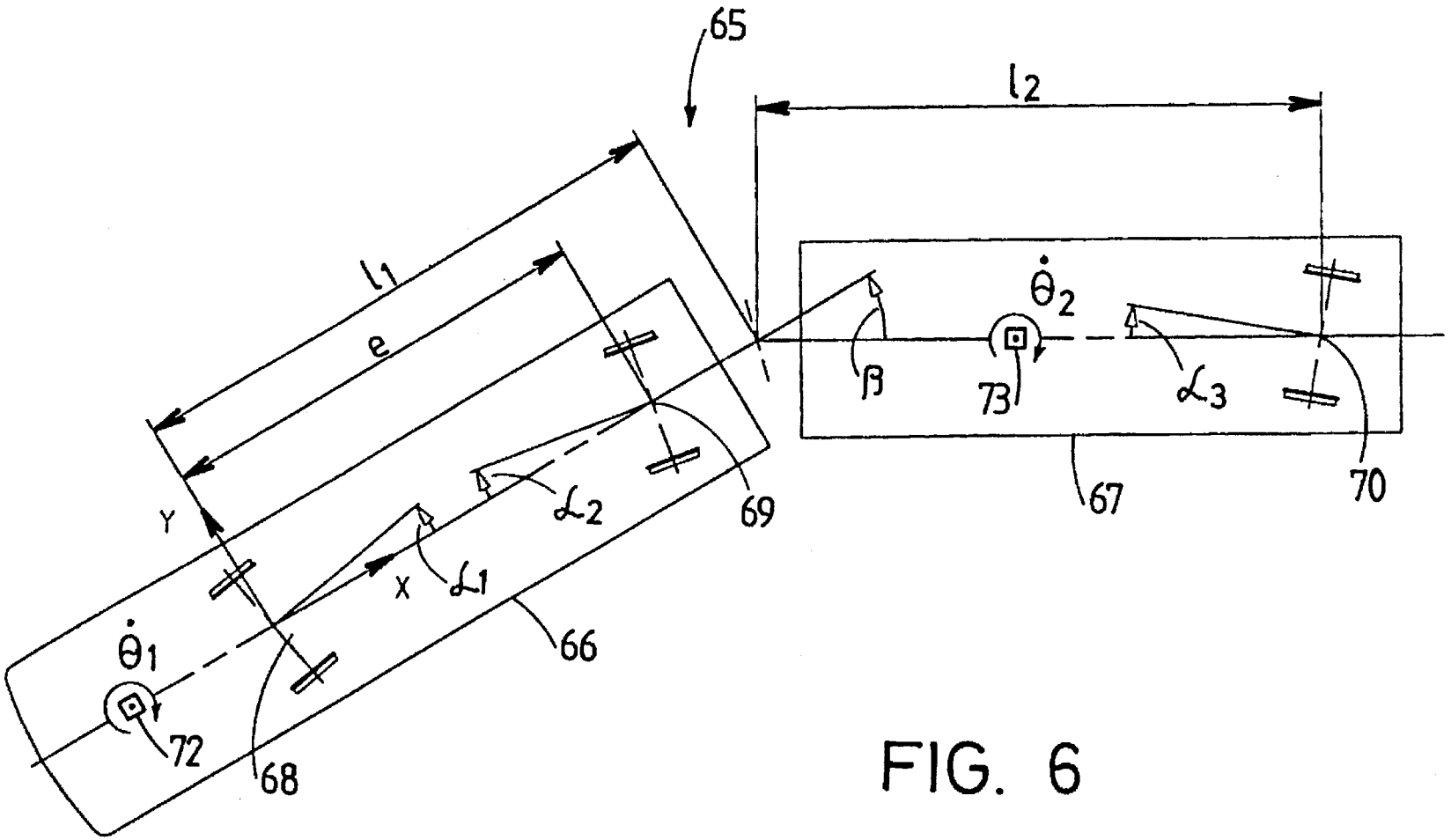
FIG. 6 is a schematic plan view of a second embodiment.

The second embodiment, shown in FIG. 6, is a string 65 comprised of two bodies 66, 67 with wheel assemblies 68, 69 and 70. Clearly, this string could also include a different number of bodies and of wheel assemblies. The originality of this embodiments is that, in addition to the measurement of the relative angle β between the bodies 66, 67, a measurement is made of the angular speed θ or of the angular variation of the rotation of the bodies around their vertical axes by means of gyroscopes 72, 73 or any other device designed for this purpose, such as gyroscopic sensors with piezoelectric members. These gyroscopic sensor devices 72, 73 are connected to the computer unit 41 to supply the same with signals corresponding to the angular speed $\dot{\theta}$ or to the angular variation of the rotation of the bodies around their vertical axis.

For each wheel assembly j, the angle $\alpha j$ between the axis of the body and the line perpendicular to the axis of the wheels is calculated in the computer unit 41 according to the equation:

$$\alpha j = N_{j1} \Delta\beta_m N_{j2} \dot{\theta}_n \Delta t \quad (3.1)$$

where $\Delta\beta_m$ is the variation of the relative angle $\beta$ measured between two successive bodies during a time interval $\Delta t$, $\dot{\theta}_n$ is the angular speed of a body n=1, 2 around its vertical axis, $N_{j1}$ and $N_{j2}$ are factors which are dependent upon the geometry of the unitary vehicle and the position of the wheel assembly (distance from the wheel device to the articulation $1_1$, $1_2$, distance e between the pivots of the wheel assemblies).

All the measurements of $\Delta\beta_m$ and of $\theta_n$ carried out for the positioning $\alpha j$ of the wheel assembly or assemblies of a body relate to this same body.

For each wheel assembly, there is one couple of different factors, $N_{j1}$, $N_{j2}$. In the ease of the intermediate bodies of strings with more than two bodies, the positioning angle $\alpha j$ of the wheel assembly or assemblies of these intermediate bodies is calculated taking into account the variation of the angle $\Delta\beta_m$ of the articulation which is the closest to the wheel assembly or assemblies concerned.

As the bodies are assumed to be totally rigid, the positioning of the gyroscopes inside the body does not influence the measurement of the speed of rotation $\dot{\theta}_n$. The time interval $\Delta t$ between the measures is typically of 0.5 seconds.

For instance, in the case of a geometry corresponding to FIG. 6, we have the following values for the last wheel assembly (70):

$N_{21}=6$ $N_{22}=0.25$ $1_2=8.005$ m.

Clearly, an excellent accuracy is obtained by placing a gyroscopic sensor on each body. However, a cheaper arrangement would include a single gyroscopic device on one body on the string 65 and use the measurements for the other bodies. Clearly, instead of measuring the angular speeds $\dot{\theta}_n$, it is also possible to measure the variations of the angle of rotation of a body around its vertical axis during given time intervals.

The adjusting members can be, for example, pneumatic or hydraulic jacks, or furthermore mechanical means controlled by a stepping motor, making it possible to achieve an accurate control of the angles $\alpha j$. In the case of a train with a plurality of wagons including articulated bodies, a calculating unit can be provided for each wagon or the train can have a single calculating unit which carries out the calculations for all the wagons.

The device according to the invention offers the considerable advantage of being transformable and adaptable to specific conditions of use. Actually, the computer unit 41 can be adapted at a low cost, to carry out improved or specific mathematical calculations aimed at optimizing at any time the adjusting of the orientation of the wheels without having to proceed to any mechanical changes on the string of vehicles.

We claim:

1. A method for adjusting the orientation of wheel assemblies having wheels which can be oriented, in a string of vehicles travelling on rails and including at least two unitary vehicles which are articulated together, the string of vehicles being supported on the rails through the wheel assemblies, the wheels having principal planes which form variable angles ($\alpha j$) with a direction parallel to a longitudinal axis of a respective unitary vehicle under which they are mounted, the method comprising: adjusting said variable angles ($\alpha j$) on the basis of the curvature of the rails in such a manner that the principal planes of the wheels coincide substantially with lines tangent to the rails, by identifying the positions of the wheel assemblies using a system of coordinates;

determining a function of an arc of at least one osculatory circle passing through the centers of three wheel assemblies;

measuring a relative angle ($\beta m$) between the longitudinal axis of at least two unitary vehicles;

calculating said variable angles ($\alpha j$) for at least one of the wheel assemblies based on said relative angle ($\beta m$) measured, wherein the value of said variable angles ($\alpha j$) is determined from a derivative of said function of the arc of the circle; and orienting the wheels of said at least one of the wheel assemblies according to said variable angles ($\alpha j$) calculated.

2. A method according to claim 1, wherein the variable angles ($\alpha j$) obtained by said at least one osculatory circle are corrected using an empirical correction function based on a variation ($\Delta\beta m/\Delta s$) of said relative angles ($\beta m$) for a certain distance travelled ($\Delta s$).

3. A method according to claim 1, adapted to strings of vehicles travelling on rails comprised of at least three unitary vehicles and of at least four wheel assemblies, further comprising calculating a first angle ($\beta 1$) between a first and a second unitary vehicle, and also a second relative angle ($\beta 2$) between the second and a third unitary vehicle, using at least said first and second relative angles ($\beta 1$, $\beta 2$) for determining at least two functions of the arc of at least two osculatory circles, a first osculatory circle passing through the centers of the first three wheel assemblies, a second osculatory circle passing through the centers of the last three wheel assemblies, and calculating the value of said variable angles ($\alpha j$) from derivatives of the two functions of the arcs of the circles, the value of the variable angles ($\alpha j$) of the wheel assemblies belonging to two osculatory circles being obtained by averaging the values obtained on each one of the osculatory circles.

4. A method according to claim 3, wherein the variable angles ($\alpha j$) obtained by said osculatory circles are corrected using corrective functions having the following form:

when the second relative angle ($\beta 2$) and the variation ($\Delta\beta 2$) of this second relative angle are equal to zero:

$$\begin{bmatrix} \Delta\beta 1 \\ \Delta s \end{bmatrix} \in \{\gamma i, \gamma i+1\} \Rightarrow \alpha 1c = \alpha 1 + \frac{\Delta\beta 1}{\Delta s} Ki$$

$$\Rightarrow \alpha 2c = \alpha 2 + \frac{\Delta\beta 1}{\Delta s} Li$$

$$\forall \left| \begin{matrix} \Delta\beta 1 \\ \Delta s \end{matrix} \right| \Rightarrow \alpha 3c = \alpha 4c = 0$$

when the variation ($\Delta\beta 2$) of the second relative angle is different from zero:

$$\alpha jc = \alpha j + \frac{\Delta\beta 1}{\Delta s} Gj + \frac{\Delta\beta 2}{\Delta s} Hj \qquad j = 1 \ldots 4$$

where $\alpha j$=calculated variable angle, without correction $\alpha jc$=variable angle, corrected $\Delta\beta 1$, $\Delta\beta 2$=variation of the first and of the second relative angles in the time interval $\Delta t$ $\Delta s$=distance travelled in the time interval $\Delta t$ at the speed v Ki, Li, Gj, Hj=predetermined correction factors, which are dependent upon the geometry of the string of vehicles travelling on rails $\gamma i$, $\gamma i+1$=limits defining the intervals for the values of the constants Ki, Li, Gj, Hj.

5. A method according to claim 4, adapted to strings of vehicles having a number of unitary vehicles in excess of three, further comprising determining a plurality of osculatory circles per group of three wheel assemblies, using all these wheel assemblies except those located at the end of the string of vehicles for the interpolation of two osculatory circles, calculating the relative angles by averaging the values obtained for each one of the two osculatory circles, and correcting the variable angles obtained using said corrective functions.

6. A method according to claim 1, further comprising measuring at least one of the angular speed of rotation ( $\dot{\theta}_n$) and the angular variation of the rotation of at least one unitary vehicle around a vertical axis, and calculating said variable angle ($\alpha j$) for at least one unitary vehicle while taking into account the speed or angular variation measured and the difference in the relative angles ($\Delta\beta m$) measured between the longitudinal axes of at least two unitary vehicles during a predetermined time interval ($\Delta t$).

7. A method according to claim 6, wherein the variable angle ($\alpha j$) for each one of the unitary vehicles is calculated from the equation $$\alpha j = N_{j1}\Delta\beta_m + N_{j2}\dot{\theta}_n\Delta t$$

where $\Delta\beta_m$ is the variation of the relative angle $\beta$ measured between two successive unitary vehicles during a given time interval $\Delta t$, $\dot{\theta}_n$ is the angular speed of rotation of a unitary vehicle n around a vertical axis, and $N_{j1}$ and $N_{j2}$ are factors which are dependent upon the geometry of the unitary vehicle and the position of the wheel assembly on the unitary vehicle.

8. A method according to claim 7, wherein the variation or angular speed is measured with a gyroscopic sensor device.

9. A string of vehicles travelling on rails comprising m+1 unitary vehicles which are articulated together, these string of vehicles being supported on the rails through wheel assemblies having wheels which can be oriented, said wheels having a principal plane which forms a variable angle ($\alpha j$) with a direction parallel to a longitudinal axis of a respective unitary vehicle under which they are mounted, at least one adjusting device for adjusting said variable angle ($\alpha j$) on the basis of the curvature of the rails, in such a manner that the principal plane of the wheels coincides substantially with a line tangent to the rails, said adjusting device including means for determining a function of an arc of at least one circle passing through centers of the wheel assemblies, m measuring members for determining m relative angles ($\beta m$) between the longitudinal axes of two unitary vehicles, means for feeding the relative angles to at least one calculating unit for calculating the variable angles ($\alpha j$) for each one of the wheel assemblies on the basis of said relative angles ($\beta m$), said calculating unit including means for determining the value of said variable angles from a derivative of said function of the arc of the circle, and adjusting means associated with the wheel assemblies for orienting the wheels according to said variable angles ($\alpha j$) calculated.

10. A string of vehicles according to claim 9, further including at least one gyroscopic sensor device positioned on at least one unitary vehicle for measuring one of the angular speed and the angular rotation of the unitary vehicle around a vertical axis.

11. A string of vehicles according to claim 10, wherein each unitary vehicle is provided with a gyroscopic sensor device connected to said calculating unit.

* * * * *